US006938961B2

(12) United States Patent
Broom

(10) Patent No.: US 6,938,961 B2
(45) Date of Patent: Sep. 6, 2005

(54) APPARATUS FOR BREAKING UP SOLID OBJECTS

(75) Inventor: Gilbert R. Broom, Schereville, IN (US)

(73) Assignee: Cutting Edge Technologies, LLC, Remington, IN (US)

( * ) Notice: Subject to any disclaimer, the term of this patent is extended or adjusted under 35 U.S.C. 154(b) by 0 days.

(21) Appl. No.: 10/395,003

(22) Filed: Mar. 21, 2003

(65) Prior Publication Data

US 2003/0222496 A1 Dec. 4, 2003

Related U.S. Application Data

(60) Provisional application No. 60/366,433, filed on Mar. 21, 2002.

(51) Int. Cl.[7] ..... E21C 35/18
(52) U.S. Cl. ..... 299/100; 299/113
(58) Field of Search ..... 299/100, 113, 299/79.1

(56) References Cited

U.S. PATENT DOCUMENTS

| | | | | |
|---|---|---|---|---|
| 531,334 | A | * 12/1894 | Ross | 299/100 |
| 1,174,433 | A | * 3/1916 | Mowlds | 299/100 |
| 1,463,848 | A | 8/1923 | Shimin | |
| 1,486,708 | A | * 3/1924 | Wells | 277/521 |
| 1,534,850 | A | 4/1925 | Hamilton | |
| 1,637,332 | A | 8/1927 | Bronson | |
| 1,943,880 | A | 1/1934 | Rea | |
| 2,562,899 | A | 8/1951 | Finn | |
| 2,952,270 | A | 9/1960 | Fulton et al. | |
| 3,172,483 | A | 3/1965 | Spitzer | |
| 3,336,081 | A | * 8/1967 | Ericsson | 299/113 |
| 3,509,723 | A | 5/1970 | Dorn | |
| 3,554,306 | A | 1/1971 | Wilburn | |
| 3,655,244 | A | * 4/1972 | Swisher | 299/113 |
| 3,773,118 | A | 11/1973 | Shanks et al. | |
| 3,999,805 | A | 12/1976 | Lockwood | |
| 4,113,405 | A | 9/1978 | Dillinger | |
| 4,320,924 | A | 3/1982 | Langfield et al. | |
| 4,412,571 | A | * 11/1983 | Czerniewicz | 144/219 |
| 4,634,311 | A | 1/1987 | Jinnings et al. | |
| 4,852,672 | A | 8/1989 | Behrens | |
| 4,895,349 | A | 1/1990 | Broom | |
| 4,911,729 | A | 3/1990 | Rooker | |
| 5,020,780 | A | 6/1991 | Woodings | |
| 5,399,051 | A | 3/1995 | Aken et al. | |
| 5,490,740 | A | 2/1996 | Johnson | |
| 5,695,254 | A | 12/1997 | Shinners et al. | |
| 5,704,740 | A | 1/1998 | Ebenhoch et al. | |
| 5,803,550 | A | 9/1998 | Watson et al. | |
| 6,012,881 | A | 1/2000 | Scheer | |
| 6,035,953 | A | 3/2000 | Rear | |

FOREIGN PATENT DOCUMENTS

| | | |
|---|---|---|
| DE | 15 83 806 | 9/1970 |
| DE | 30 25 890 A1 | 1/1982 |
| EP | 0 383 737 | 8/1990 |
| GB | 13399 | 5/1906 |
| GB | 686336 | 1/1953 |
| GB | 1 470 064 | 4/1977 |
| GB | 1 564 473 | 4/1980 |
| GB | 2 120 156 A | 11/1983 |
| SU | 1771509 A3 | 10/1992 |
| WO | WO 95/29030 | 11/1995 |

OTHER PUBLICATIONS http://www.glossary.oilfield.slb.com/Display.cfm?Term=packing%20gland.*
Neale, "The Tribology Handbook" p. B25.1.*
McMaster–Carr Supply Company–Catalog 99 "Wood Boring Bits," pp. 1837–1842.
McMaster–Carr Supply Company–Catalog 99 "Pneumatic Scaling Tools," pp. 2200–2202.

* cited by examiner

*Primary Examiner*—John Kreck
(74) *Attorney, Agent, or Firm*—Wallenstein Wagner & Rockey, Ltd.

(57) ABSTRACT

An improved buster point assembly is disclosed. The improved buster point assembly has an elongated shaft attached to a replaceable tip. The replaceable tip includes a working end and a connecting end, the connecting end has a chamber for receiving a distal end of the elongated shaft.

3 Claims, 4 Drawing Sheets

APPARATUS FOR BREAKING UP SOLID OBJECTS

RELATED APPLICATION

This application claims the benefit of Provisional Patent Application Ser. No. 60/366,433, filed Mar. 21, 2002.

TECHNICAL FIELD

The present invention relates to a method and apparatus for breaking up solid objects. More particularly, the invention relates to an improved buster point for breaking up concrete and the like with increased efficiency.

BACKGROUND ART

Buster points are used for breaking up solid material such as asphalt, concrete, and solidified metals. Small buster points which are approximately twenty-four inches in length are used in jack hammers. Large buster points having lengths up to eight feet are installed on large road-working equipment for such applications as bridge and road demolition. Buster points are also used in the steel industry for breaking residue off ladles and troughs.

Commercially available buster points are manufactured to a unibody construction and comprise a tip integrally connected to a long shaft. The tips of the buster points can dull fairly easily through field application due, in large part, to the great amount of force associated with breaking up dense materials. Historically, upon dulling of the tip, the buster point is either scrapped, or the entire buster point is forwarded to a blacksmith for rebuilding. Both of these scenarios are very expensive. In the first case, a total loss of the product occurs. In the second case, the user must pay to ship the buster point as well pay the blacksmith for extensive repair and rebuilding of the buster point.

Prior art buster point assemblies have also been manufactured as illustrated in FIGS. 1 through 5. These assemblies include a shaft, a replaceable tip, and a connector. The replaceable tip is fixedly attached to the shaft using the connector. The shaft includes a proximal end and a distal end. The proximal end serves as the drive end. Accordingly, the proximal end includes a means for connecting the shaft to a drill mechanism. A chamber is bored into the shaft at the distal end. The chamber is adapted to receive the replaceable tip. An aperture is also bored through the shaft. The aperture includes threads for receiving the connector.

The replaceable tip includes a working end and a connecting end. The working end is designed to break up solid material. The connecting end is adapted to fit within the chamber located at the distal end of the shaft. The connecting end includes a tapered section. In operation, the connector fits within the tapered section to fixedly attach the replaceable tip to the shaft.

The drawback of this prior art assembly is that bearing surface between the replaceable tip and the shaft can be damaged as the buster point pounds against very dense, solid objects. For example, the bearing surface can become spalled or bent by the constant pounding. Consequently, the replaceable tip could become difficult or impossible to remove from the shaft. Thus, the entire assembly would have to be replaced, rather than the less expensive replaceable tip.

The present invention is provided to solve these and other problems.

SUMMARY OF THE INVENTION

An object of the present invention is to provide an improved buster point assembly. The improved buster point assembly of the present invention comprises an elongated shaft and a replaceable tip. The elongated shaft is centered about a longitudinal axis, and has a proximal end adapted for connection to an external drilling or percussion mechanism and a distal end. The replaceable tip has a working end adapted for contacting and breaking up a solid object and a connecting end. The connecting end has a chamber for receiving the distal end of the elongated shaft.

Other advantages and aspects of the present invention will become apparent upon reading the following description of the drawings and detailed description of the invention.

DETAILED DESCRIPTION

Figure 1:
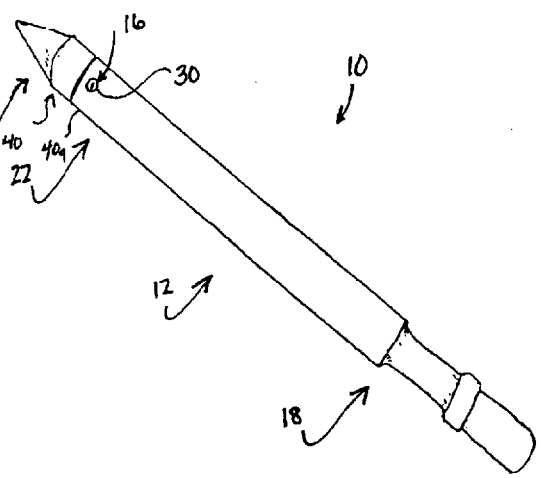
Fig 1 (Prior Art)
FIG. 1 is a perspective view of a buster point assembly of the prior art.

While the invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

A prior art buster point assembly 10 is illustrated in FIGS. 1–5. The prior art buster point assembly 10 comprises a shaft 12, replaceable tip 14, and a connector 16. The replaceable tip 14 is joined to the shaft 12 using the connector 16.

Figure 2:
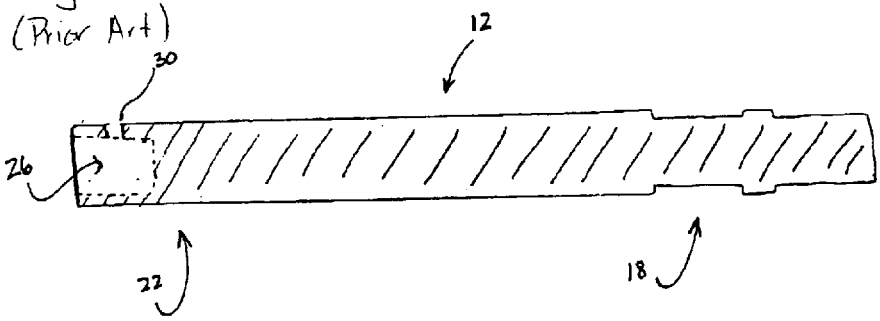
Fig. 2 (Prior Art)
FIG. 2 is a cross-sectional view of a prior art buster point shaft.
Figure 3:
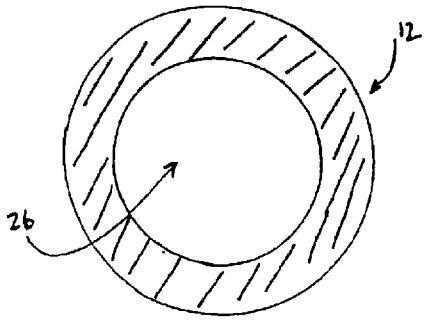
Fig. 3 (Prior Art)
FIG. 3 is an end view of a prior art buster point shaft.

The shaft 12 includes a proximal end 18 and a distal end 22. The proximal end 18 serves as the drive end. Accordingly, the proximal end 18 includes a means for connecting the shaft 12 to a drill mechanism, such as a jack hammer or the like. As shown in FIGS. 2 and 3, a chamber 26 is bored into the shaft at the distal end 22. The chamber 26 is adapted to receive the replaceable tip 14. An aperture 30 is also bored through the shaft 12. The aperture 30 includes threads for receiving the connector 16. The combination of the threaded aperture 30 and the connector 16 fixedly attaches the replaceable tip 14 to the shaft 12.

Figure 4:
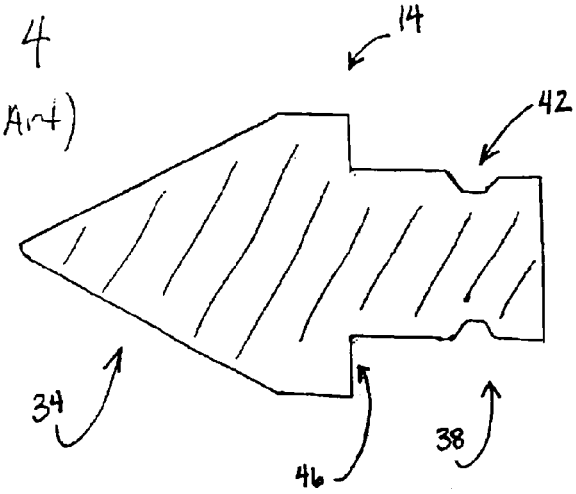
Fig. 4 (Prior Art)
FIG. 4 is a cross-sectional view of a prior art buster point tip.

Referring to FIG. 4, the replaceable tip 14 includes a working end 34 and a connecting end 38. The working end 34 is designed to break up solid material. The connecting end 38 is adapted to fit within the chamber 26 located at the proximal end 18 of the shaft 12. The connecting end 38 includes a tapered section 42. In operation, the connector 16 fits within the tapered section 42 to fixedly attach the replaceable tip 14 to the shaft 12.

The replaceable tip 14 also includes a butt plate 46. The butt plated 46 absorbs much of the force associated with the hammering and breaking up of solid objects and transfers the force to a bearing surface located on the shaft 12.

The connector 16 is generally a set screw. The connector 16 serves to draw the replaceable tip 14 against the shaft 12 and secure the unit.

Figure 5:
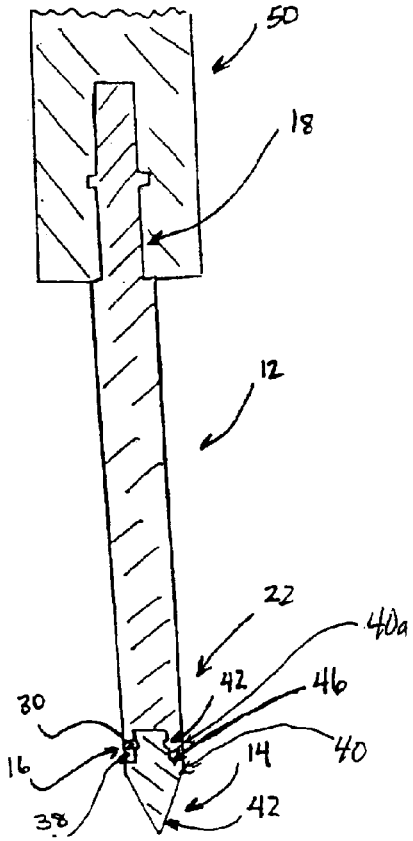
Fig. 5 (Prior Art)
FIG. 5 is a cross-sectional view of a prior art buster point assembly attached to an external drilling mechanism.
Figure 6:
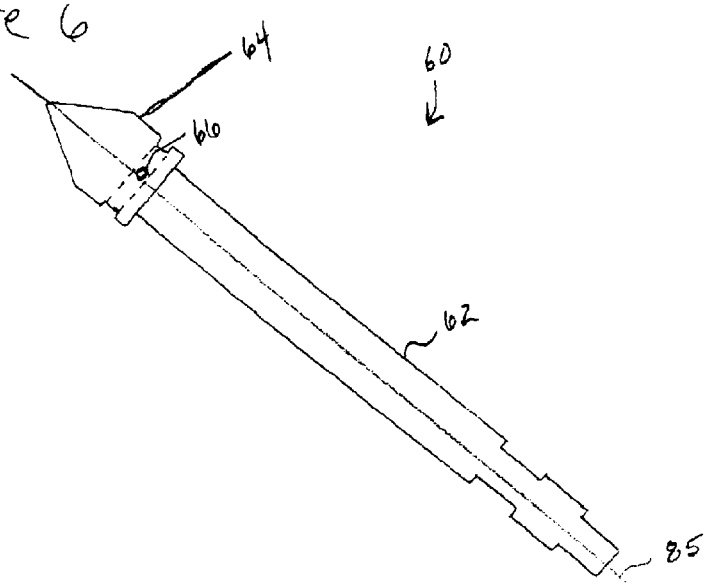
FIG. 6 is a cross-sectional view of the buster point of the present invention.

Referring to FIG. 5, in operation, the buster point 10 is attached to an external drilling mechanism 50, such as a jackhammer or other impact providing mechanism including those attached to road service vehicles for demolishing bridges, roads, and the like. The replaceable tip 12 is placed in contact with a solid object. A force is applied by the drilling mechanism 50 to the buster point 10. When the replaceable tip 14 of the buster point 10 becomes worn or dull, it can be removed from the buster point 10 by disconnecting the connector 16 from the connecting end 38 and replaced with another tip 14.

The present invention is directed to an improved buster point assembly 60 as illustrated in FIGS. 6–9. The buster point assembly 60 of FIGS. 6–9, also comprises an elongated shaft 62, replaceable tip 64, and a connector 66. The replaceable tip 64 is joined to the shaft 62 using the connector 66. The replaceable tip 64 of the improved assembly 60 includes a female housing for receiving a portion of the shaft 62. With the assembly 60 of the present invention, when the replaceable tip 64 dulls, it can be easily replaced in the field. The assembly 60 of the present invention significantly reduces the cost of buster points in various industries. The assembly 60 also allows reduces the cost associated with rebuilding an entire buster point unit.

Figure 7:
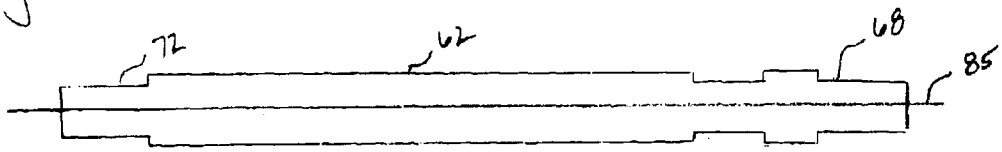
FIG. 7 is a cross-sectional view of an elongated shaft for the buster point assembly of FIG. 6.

The shaft 62 includes a proximal end 68 and a distal end 72. The proximal end 68 serves as the drive end. Accordingly, the proximal end 68 includes a means for connecting the shaft 62 to a drill mechanism, such as a jack hammer or the like. As shown in FIG. 7, the distal end 72 includes a region of reduced diameter as compared to an adjacent portion of the shaft 62, the purpose of which will become clear upon further description. The shaft 62 can be generated in a variety of lengths and diameters, and the proximal end 68 of the shaft 62 can be adjusted to fit differing drill or percussion mechanisms.

Figure 8:
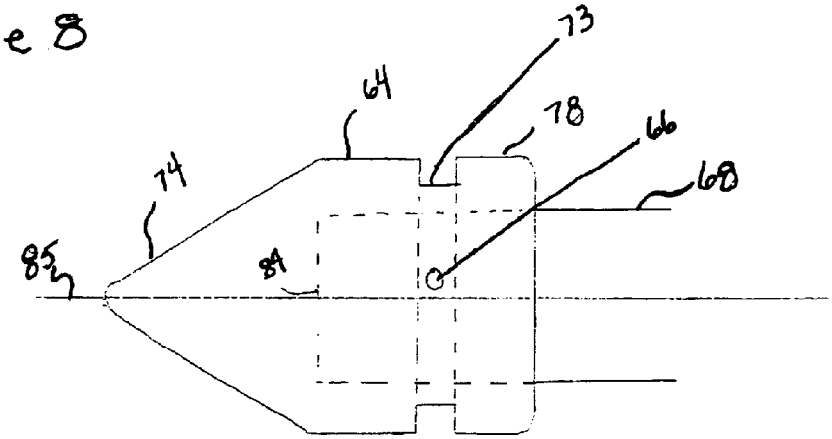
FIG. 8 is a partial cross-sectional view of the buster point assembly of FIG. 6.
Figure 9:
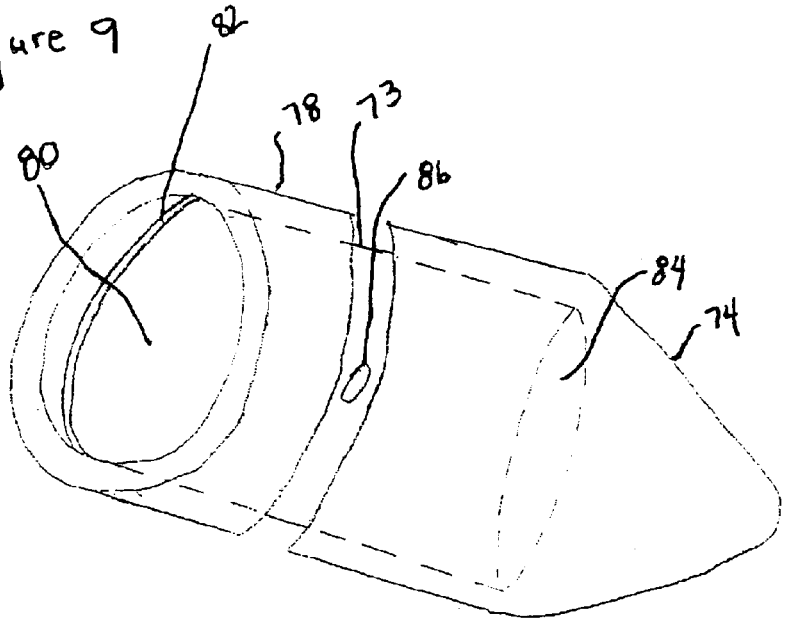
FIG. 9 is a perspective view of the buster point of the buster point assembly of FIG. 6.

Referring to FIGS. 8 and 9, the replaceable tip 64 includes a banding recess 73, a working end 74 and a connecting end 78. The working end 74 is designed to break up solid material. The connecting end 78 includes a chamber 80 which is adapted to receive the region of reduced diameter of the shaft 62. The chamber 80 includes packing gland 82 and a bearing surface 84. The packing gland 82 is a device used to seal around a reciprocating or rotating shaft or spindle. This enables a seal to be tightened to suit the operating conditions and allows subsequent adjustment to account for wear.

In use, the bearing surface 84 is in communication with the distal end 72 of the shaft 62. Preferably, the bearing surface 84 of the buster point assembly 60 of the present invention and the distal end 72 of the shaft 62 are generally planar and perpendicular to a longitudinal axis 85 extending the length of the assembly 60 about which the entire assembly is centered. This arrangement provides a marked improvement over the buster point assemblies of the prior art because the effective area of the bearing surface 84 is substantially larger than the effective bearing surfaces of prior art assemblies. This effective area is generally equal to the area of an end surface of the distal end 72 of the shaft 62. The area of an opening to the chamber 80 is preferably just large enough to accommodate the distal end of the shaft. Moreover, the volume of the chamber is preferably just great enough to accommodate the distal end of the shaft. This arrangement reduces damage to the distal end 72 of the shaft 62 during use, and the replaceable tip 64 can always be removed from the shaft 62 with little or no difficulty.

An aperture 86 is also bored through the shaft 64. The aperture 86 includes threads for receiving the connector 66. The combination of the threaded aperture 86 and the connector 66 fixedly attaches the replaceable tip 64 to the shaft 62.

The replaceable tip 64 can be manufactured to reflect any buster point tip that is currently available in the marketplace, including conical, spike, and chisel shapes. The replaceable tip 64 can also be varying lengths and diameters.

The connector 66 is generally a set screw. The connector 66 serves to draw the replaceable tip 64 against the shaft 62 and secure the unit.

Identical to the prior art assembly, the improved buster point assembly 60 is attached to an external drilling mechanism, such as a jackhammer or other impact providing mechanism including those attached to road service vehicles for demolishing bridges, roads, and the like. The replaceable tip 62 is placed in contact with a solid object. A force is applied by the drilling or percussion mechanism to the buster point assembly 60. When the replaceable tip 64 of the buster point assembly 60 becomes worn or dull, it can be removed from the assembly 60 by disconnecting the connector 66 from the connecting end 68 and replaced with another tip 64.

It should be understood that the buster point assembly 60 of the present invention can also be generated with a threaded replaceable tip 64. The threaded replaceable tip 64 can be screwed onto the distal end 72 of the shaft 62, and thus no connector is required.

While a specific embodiment has been illustrated and described, numerous modifications are possible without departing from the spirit of the invention, and the scope of protection is only limited by the scope of the accompanying claims.

I claim:

1. A buster point assembly for breaking up a solid body of material, the buster point assembly comprising:

an elongated shaft centered about a longitudinal axis and having a proximal end adapted for connection to an external drilling or percussion mechanism and a distal end; and, a replaceable tip having a working end adapted for contacting and breaking up a solid object and a connecting end having a chamber for receiving the distal end of the elongated shaft, wherein said chamber includes a packing gland for creating a seal between said elongated shaft and said replaceable tip and said chamber includes a planar bearing surface perpendicular to said longitudinal axis, said planar bearing surface having an area equal to an end portion of said distal end of said elongated shaft, and said distal end of said elongated shaft having a smaller diameter than an adjacent portion of said elongated shaft and including a planar portion in communication with said planar bearing surface.

2. The buster point assembly of claim 1 further comprising a set screw wherein said replaceable tip includes an aperture for receiving said set screw wherein set screw engages said a portion of said distal end of said elongated shaft to separably attach said replaceable tip to said distal end of said elongated shaft.

3. The buster point assembly claim 2 wherein said aperture includes a threaded portion for cooperative engagement with said set screw.

* * * * *

UNITED STATES PATENT AND TRADEMARK OFFICE

CERTIFICATE OF CORRECTION

PATENT NO. : 6,938,961 B2
DATED : September 6, 2005
INVENTOR(S) : Gilbert R. Broom It is certified that error appears in the above-identified patent and that said Letters Patent is hereby corrected as shown below:

Title page,
Item [56], References Cited, U.S. PATENT DOCUMENTS, add:
-- 1,477,855 A 12/1923 Thurston --.

Signed and Sealed this

Fourth Day of April, 2006

JON W. DUDAS
*Director of the United States Patent and Trademark Office*